United States Patent [19]

Seuster

[11] Patent Number: 4,736,785

[45] Date of Patent: Apr. 12, 1988

[54] ROLL-UP

[76] Inventor: Kurt Seuster, Mühlenbach 9, 5990 Altena, Fed. Rep. of Germany

[21] Appl. No.: 891,786

[22] Filed: Jul. 30, 1986

[30] Foreign Application Priority Data

Jul. 30, 1985 [DE] Fed. Rep. of Germany ... 8521854[U]

[51] Int. Cl.[4] ..... E06B 9/34

[52] U.S. Cl. ..... 160/264; 160/266; 160/229.1

[58] Field of Search ..... 160/264, 266, 235, 236, 160/229 R, 238

[56] References Cited

U.S. PATENT DOCUMENTS

| | | | |
|---|---|---|---|
| 296,373 | 4/1884 | Wilson | 160/264 |
| 972,422 | 10/1910 | Whitmore | 160/264 |
| 1,106,624 | 8/1914 | Cadwallader et al. | 160/264 X |
| 3,319,697 | 5/1967 | Krohn | 160/229 R |
| 3,489,200 | 1/1970 | Recchione | 160/235 |
| 4,532,973 | 8/1985 | DeFalco | 160/235 |
| 4,569,383 | 2/1986 | Wentzel | 160/229 R |

FOREIGN PATENT DOCUMENTS

| | | | |
|---|---|---|---|
| 220411 | 8/1967 | Sweden | 160/235 |

*Primary Examiner*—Reinaldo P. Machado
*Attorney, Agent, or Firm*—Becker & Becker, Inc.

[57] ABSTRACT

A roll-up door for opening and closing off door and gate openings. The roll-up door includes a hanging portion that is made of flexible material, is in a sheet-like form, and is guided along its sides in a frame. To increase the wind stability and strength of the hanging portion, profiled stabilizing members are securely connected to the hanging portion. The stabilizing members extend along the hanging portion at right angles to the direction of travel of the latter.

21 Claims, 8 Drawing Sheets

ROLL-UP

BACKGROUND OF THE INVENTION

1. Field of the Invention

The present invention relates to a sliding door (or more appropriately a rolling door or roll-up door) for opening and closing off door and gate openings, with the door including a hanging portion that is made of flexible material, is in a sheet-like form, and is guided along its sides in a frame.

2. Description of the Prior Art

Roll-up doors of the aforementioned general type are used, on the one hand, when little heat and noise are to be allowed through, and, on the other hand, when a transparent hanging portion is desired. In contrast to conventional sliding doors having interengaging profiled sections, sliding doors of the aforementioned general type allow no greater amount of heat and noise to pass through at the connection locations, and can be made of entirely transparent synthetic materials. However, such roll-up doors have the drawback that they are less wind stable and not as strong as conventional roll-up doors that are made of profiled sections. As a result, there is a greater danger that a break in could occur. Furthermore, the synthetic materials that are used can be rolled only to a limited extent, since at low temperatures they become stiff, and at high temperatures they tend to jam in the lateral guides. Finally, at low temperatures cold flow of the synthetic material is also possible, resulting in stretching of the hanging portion of the roll-up door.

An object of the present invention therefore is to provide an improved roll-up door that is provided with a hanging portion in sheet-like form, with such a hanging portion allowing little heat and noise to pass through, it being entirely or partially transparent if desired, and having a sufficient wind stability and strength, so that it is also suitable for closing off large building openings.

BRIEF DESCRIPTION OF THE DRAWING

This object, and other objects and advantages of the present invention, will appear more clearly from the following specification in conjunction with the accompanying schematic drawings, in which.

SUMMARY OF THE INVENTION

Figure 1:
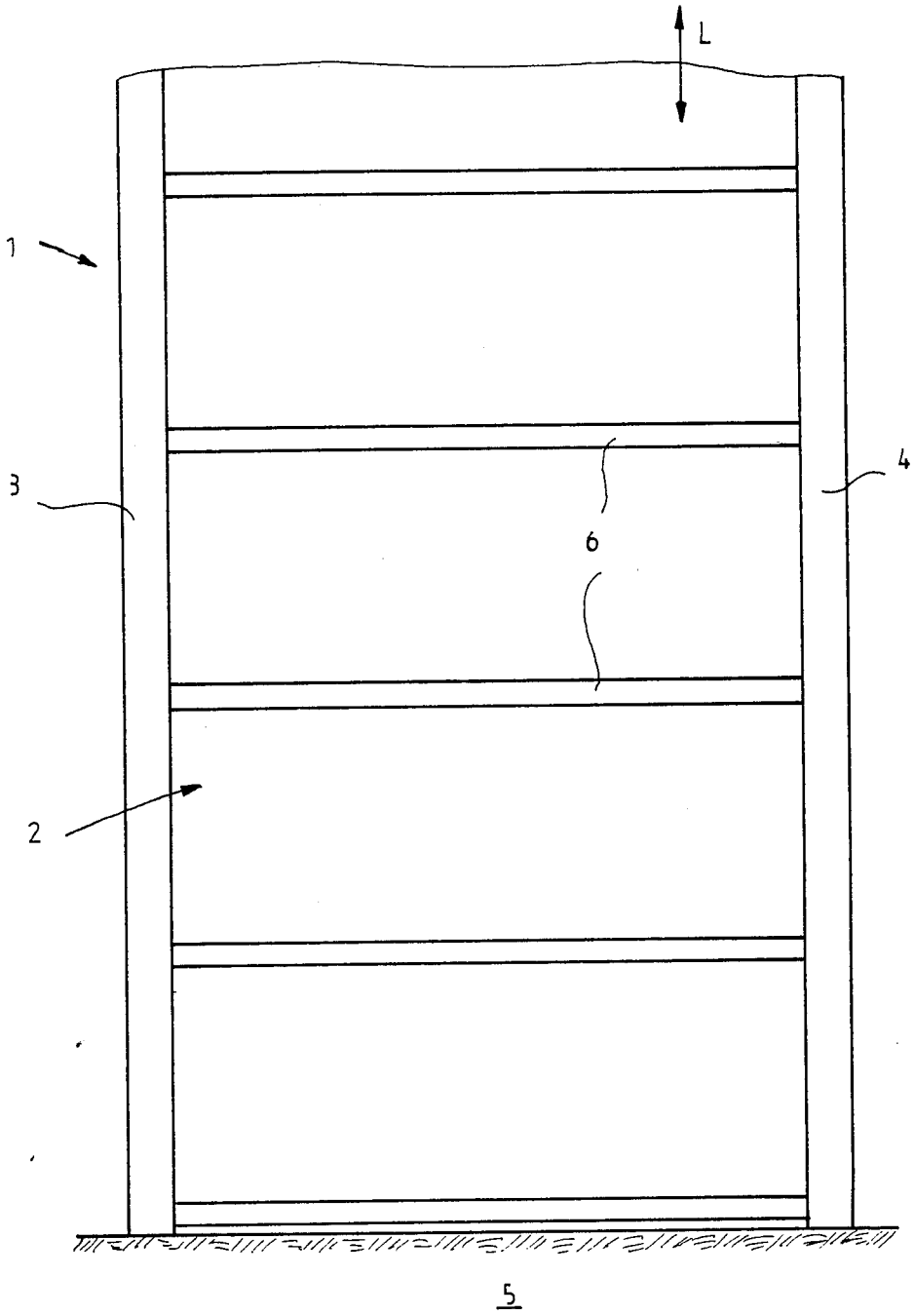
FIG. 1 shows one inventive embodiment of a hanging portion that is provided with profiled stabilizing members, and is disposed in its lateral guide rails.

The roll-up door of the present invention is characterized primarily by profiled stabilizing members that are securely connected to the hanging portion, with these stabilizing members extending along the hanging portion at right angles to the direction of travel of the latter.

A roll-up door constructed pursuant to the inventive teaching has the advantages that it has an increased stability without increasing the amount of heat or noise that passes through; nor is the amount of light or the transparency noticeably reduced. Thus, even for large building openings, the inventive roll-up doors can be equipped with a hanging portion that is relatively thin. This provides a very economical approach to the problem, because the profiled stabilizing members can be standard structural elements that are mass produced, and because the machining processes are simple and few steps are required. Furthermore, it is possible to partially or entirely retrofit existing roll-up doors with profiled stabilizing members in the inventive manner. Finally, an inventive roll-up door, even if it is transparent, can be readily recognized as an obstacle, thus nearly completely eliminating all possible sources for an accident, and in addition reducing the danger of a break in.

The profiled stabilizing members can be disposed on one or both sides of the hanging portion, depending upon whether a smooth surface is to be produced, or whether a particularly high wind stability and strength is to be achieved. If the profiled stabilizing members are disposed on one side of the hanging portion, the rolling process is quieter and smoother, since the profiled stabilizing members cannot catch on one another.

If the profiled stabilizing members are placed in recessed portions of the hanging portion, their connection with the latter is particularly secured. If the profiled stabilizing members are to be flush with the outer side of the hanging portion, a hanging portion can be obtained that is smooth both on the inner as well as the outer side.

The hanging portion of the roll-up door can also be comprised of segments that are interconnected by the profiled stabilizing members, so that the flexible material can be made into sheets having only a narrow width, and can basically span door and gate openings having any desired dimension. Furthermore, it is possible to produce a segmented hanging portion of various materials and/or various dimensions, so that, for example, the most highly stressed segments can have a greater thickness.

Pursuant to a further embodiment of the present invention, the profiled stabilizing members can comprise halves that pivotably interconnected, with their pivot axes being disposed parallel to the rolling-up axis of the hanging portion, with these halves being secured to the various segments of the hanging portion. In this way, the ability of the hanging portion to be rolled up is assured even if the segments become stiff when the temperature drops. This is so because under such conditions the hanging portion can be rolled up like a conventional roll-up door made of profiled sections, with the residual flexibility of the segments aiding small rolling radii. Furthermore, the increased mobility of the hanging portion also results in a jam-free and low level noise sliding in the lateral guides, since the hanging portion can deflect as soon as it is on the point of jamming at any particular spot.

The halves of the profiled stabilizing members can, for example, be connected by joints that are formed by eyes, which are securely connected to the halves, and connection pins that are inserted in the eyes. Such a configuration can be expedient if an existing roll-up door is to be retrofitted with profiled stabilizing members.

Pursuant to a further inventive embodiment, the upper half of the profiled stabilizing members can have an upwardly open recess that extends in the direction of the pivot axis, with a flange, of the lower half, that is bent and also extends in the direction of the pivot axis engaging the aforementioned recess. By integrally forming a recess and the bent flange with the corresponding halves of the profiled stabilizing members, there results a very straightforward construction that operates without additional connecting pins and can be assembled in a simple manner.

The inside of the recess can be rounded, and the outside of the flange that engages therein can also be rounded, so that the transfer of force between the halves of the profiled stabilizing members is favorable, with a long and narrow sealng gap being obtained in the halves, and a minimum-play connection of the halves resulting. A further improvement of the guidance between the halves can be achieved if the recess has a V-shaped cross-sectional shape, and if the bent flange that engages therein is supported along the inner fold of the recess. The flange, which is bent in a hook-like fashion, can in addition be hooked into most heretofore known roll-up door profiles.

Pursuant to another embodiment of the present invention, the halves of the profiled stabilizing members can be provided with end stops that in the extended state of the halves rest against one another and prevent the halves from carrying out a pivoting movement away from the rolling axis. In this way, the strength of the hanging portion is further increased, because the end stops prevent the unrolled hanging portion from being pressed in from both sides. Furthermore, it is easier to introduce the hanging portion into the lateral guides.

In a further inventive embodiment, the halves of the profiled stabilizing members are provided with grooves to receive a flexible profiled insulating member that bridges the gap between the halves, so that a completely closed-off hanging portion can be provided. If the insulating member is displaceably inserted in one of the grooves, the stressing thereof can be reduced, so that insulating material that is not very elastic can also be used.

Pursuant to another embodiment of the present invention, the profiled stabilizing members can be disposed between hanging segments that are separated from one another, as a result of which the material is optimally utilized, and it is possible to have a hanging portion of uniform thickness without additional recessed portions.

Pursuant to yet another inventive embodiment, the profiled stabilizing members can be secured to the sides of the hanging portion segments via flanges, thus making it possible to have a uniform introductional force from the stabilizing members into the segments. The connection of the stabilizing members with the segments can, for example, be effected by having the flanges support securing elements that are guided through openings of the segments of the hanging portion, with the securing elements clamping the segments with the flange. The force introduction into the segments is particularly favorable if the securing elements are supported against the segments of the hanging portion via pressure or fastening plates.

Pursuant to a further inventive embodiment, the profiled stabilizing members can be provided with longitudinal slots for the insertion of the edges of the hanging portion segments, thus making possible a symmetrical introduction of force into the segments. The insertion of the segments into the longitudinal slots is facilitated if one of the sides of the stabilizing members that delimits the longitudinal slots can be bent to the side. For this purpose, the thickness of one of the sides can be reduced, or an additional joint or hinge can be provided.

Pursuant to a further embodiment of the present invention, those sides of the profiled stabilizing members that delimit the longitudinal slots can be clamped to the inserted segments of the hanging portion via securing elements that are inserted therethrough and are guided through openings in the edges of the segments, so that a particularly great clamping force is applied. If the openings in the edges of the segments are holes, the segments are fixedly connected with the profiled stabilizing members, with the securing elements exerting an additional holding force upon the inner edges of the holes.

Pursuant to a further inventive embodiment, each profiled stabilizing member covers two hanging portion segments that are separated from one another, with the stabilizing members being disposed on the outer and inner sides of the hanging portion, and with each profiled stabilizing member on the outer side being securely connected with a profiled stabilizng member on the inner side. In this way, the segments of a hanging portion can be interconnected in a simple manner, with high holding forces also being achieved thereby.

Pursuant to another inventive embodiment, pointed studs are disposed on those sides of the profiled stabilizing members that face the hanging portion. When the stabilizing members are connected to the hanging portions, these studs penetrate the segments of the latter. If the studs of those stabilizing members on the outer side of the hanging portion are offset relative to the studs of the stabilizing members on the inner side of the hanging portion, the cross-sectional area of the segments is not unnecessarily weakened during penetration of the studs into the segments.

In another inventive embodiment, the longitudinal slots of the profiled stabilizing members are provided with undercuts, and the ends of the segments have widened portions that interlock with the undercuts, so that the ends of the segments can be inserted from the side into the longitudinal slots of the stabilizing members. This reduces the number of components that are required, and also reduces assembly time. Furthermore, this connection can only be detached when the hanging portion is removed from the lateral guides.

Pursuant to another embodiment of the present invention, the profiled stabilizing members can be positively connected with complementarily shaped profiled reinforcing members, so that the profiled stabilizing members, for example by fusion or adhesion, can be connected with the hanging portion with optimum strength, and yet the desired stability and strength of the hanging portion is achieved. In so doing, profiled stabilizing members having relatively small dimensions are used. When the profiled reinforcing members are inserted into the stabilizing members, the reinforcing members are protected from environmental influences. The profiled reinforcing members can, for example, be made of light metal or steel, so that high moments of resistance can be achieved.

The hanging portion can be made, for example, of PVC, a PVC-like synthetic material, rubber, or fabric, or any desired combination of these materials. The profiled stabilizing members are preferably made of PVC, a PVC-like material, light metal, or steel, or again any desired combination of these materials.

Pursuant to another inventive embodiment, flexible contact strips can be secured to the profiled stabilizing members. These contact strips extend in the direction of travel of the hanging portion, and prevent elongation or stretching of the hanging portion as can occur, in particular, at low temperatures due to the weight of the hanging portion itself. If the profiled stabilizing members have halves that are pivotably interconnected, it is advantageous to secure the contact strps to both pivotable halves of each stabilizing member, and to interrupt the contact strip between the halves of each stabilizing member, so that pivoting movements of the halves are not obstructed.

The contact strips can be secured in a particularly simple manner by clamping them between the profiled stabilizing members and the hanging portion. If securing elements such as screws, rivets, etc. which are guided through the stabilizing members and the hanging portion are used, the contact strips can be attached to the securing elements.

It is advisable to secure the contact strips to the winding roller in order to transfer the supporting force directly to a point in or on the building.

Particularly suitable are contact strips made of a flexible material that does not stretch much, such as steel, Kevlar, nylon, etc.

With the inventive roll-up door, there is a great freedom of design since the hanging portion and/or the profiled stabilizing members and/or the contact strips can be entirely or partially made of a transparent, opaque, colored, or clear material.

Pursuant to another embodiment, the inventive hanging portion can be connected to conventional roll-up door profiled sections having interlocking eyes at the ends, with these sections being able to be wound onto the same winding roller. In this way, the great strength of a roll-up door having profiled sections can be combined with the advantages of a hanging portion that is made of flexible material in sheet-like form, so that, for example, transparent areas can be provided in a roll-up door that has profiled sections. Existing roll-up doors with profiled sections can be retrofitted by riveting, screwing, or simply suspending the inventive hanging portion thereon.

To protect against fire and/or noise, the inventive hanging portion can also be reinforced with sheets of sheet metal steel and/or insulating panels, thus making is possible to have particularly airtight protective doors. It has proven to be particularly advantageous to use a plurality of layers of the inventive hanging portion with additional sheets of sheet metal steel and/or insulating panels, thus increasing the protective effect. If the inventive hanging portion is to be disposed on the outer sides of the protective door, the latter can in addition be designed in an optically pleasing manner.

Further specific features of the present invention will be described in detail subsequently.

DESCRIPTION OF PREFERRED EMBODIMENTS

Referring now to the drawings in detail, the fragmentary view of FIG. 1 shows a, rolling, or roll-up door 1 that is provided with a hanging portion 2 of flexible material, sheets or panels of PVC, synthetic material, or rubber; the door 1 is shown in lateral guides 3, 4 that are securely anchored to the base or floor 5. Since the hanging portion 2 has no slits or gaps, it allows very little heat or noise to pass through. In addition, by using the aforementioned material it is possible to have transparent hanging portions, thus increasing the amount of light that enters the adjacent spaces and, in commercial usage, improving the operational procedure and making the work place more safe.

Since these advantages can already be achieved when the hanging portion 2 has a thickness of from 7 to 10 mm, the hanging portion of the present invention is fixedly connected with profiled stabilizing members 6 that extend on the hanging portion 2 at right angles to the direction of travel L thereof. The stabilizing members 6 can be made of steel, light metal, hard PVC, or some other suitable synthetic material. Preferably, profiled members having a high angular impulse or surface moment of inertia are used, such as U-profiles, T-profiles, or box profiles. These profiled members can be repeatedly disposed on either one or both sides of the hanging portion, or between separate segments of the hanging portion. In this manner, a sufficient wind stability and strength of the hanging portion 2 can be achieved, even for larger building openings.

Figure 2:
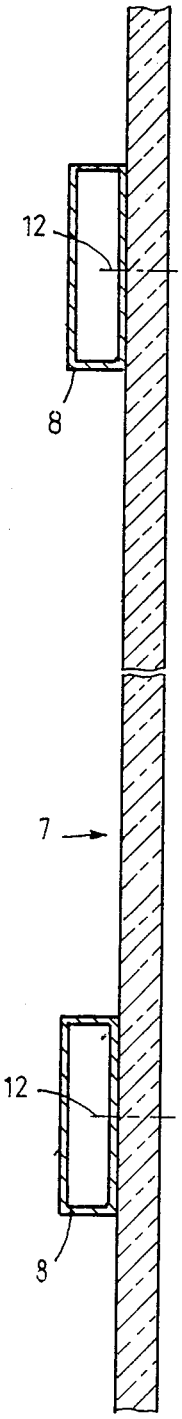
FIG. 2 shows an inventive embodiment of a hanging portion having profiled stabilizing members disposed on one side, and in particular is a cross-sectional view taken along the line II—II in FIG. 4.
Figure 3:
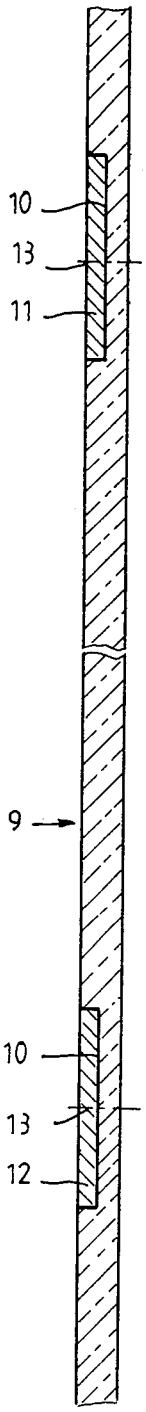
FIG. 3 shows an inventive embodiment of a hanging portion with profiled stabilizing members disposed in recessed portions on one side, and in particular is a cross-sectional view taken along the line III—III in FIG. 4A.
Figure 4:
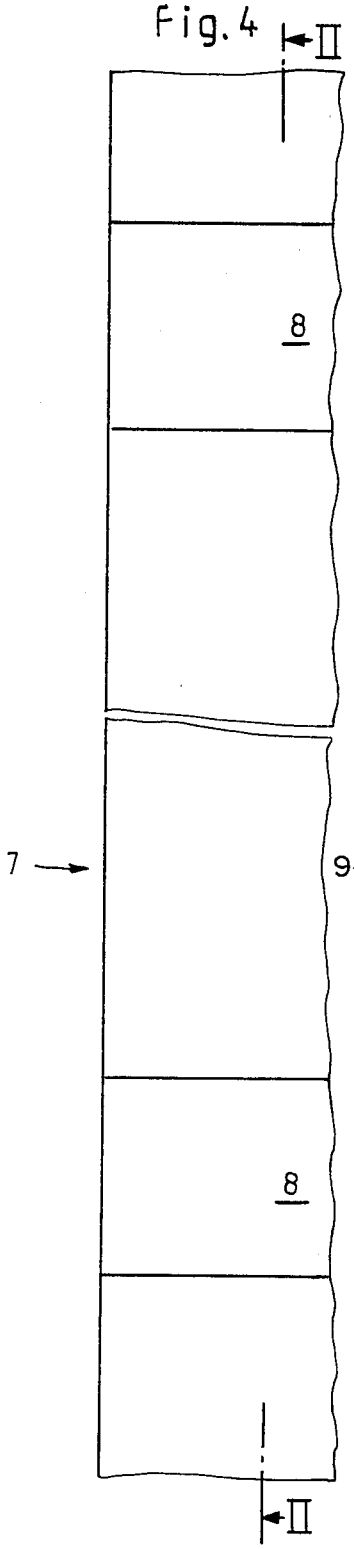
FIGS. 4 and 4A are fragmentary views of the hanging portions of FIGS. 2 and 3, respectively.
Figure 4A:
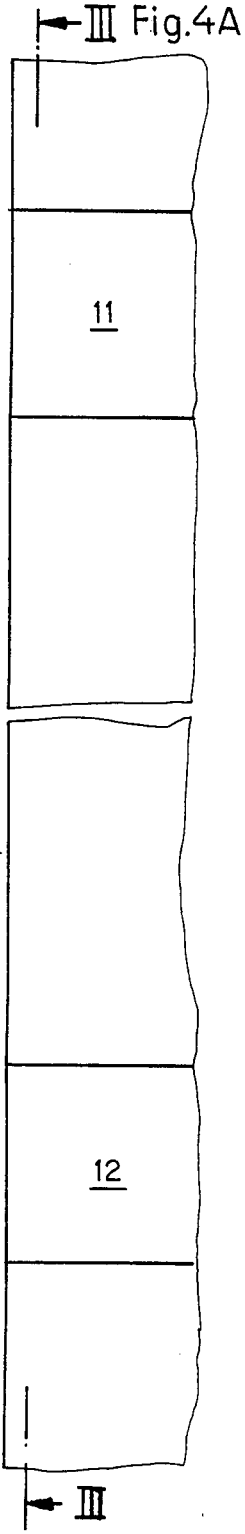

FIGS. 2 and 4 show an inventive embodiment where box-shaped profiled stabilizing members 8 are disposed on one side of a hanging portion 7. In contrast, FIGS. 3 and 4 show a hanging portion 9 that is provided with recessed portions 10 in which are placed profiled stabilizing members 11 of solid material.

In both embodiments, the profiled stabilizing members 8, 11 can be secured to the hanging portion 7, 9 via screws, rivets, bolts, pins, etc. via appropriate bores. Since when the hanging portion 7, 9 is rolled up or unrolled, the securing means 12, 13 operate in or act on these bores, it is expedient to protect the latter by inserting sheet metal sleeves therein. This type of securement is preferred when the profiled stabilizing members are made of steel or light metal.

When the profiled stabilizing members are made of synthetic material or PVC, securement of the stabilizing members can also be effected by fusion, adhesion, or some other connection. Fusing of soft or hand PVC can be effected with or without PVC welding rods. The bonding with high-strength synthetic material adhesive makes it possible to have, at relatively great effort, bonds that are mechanically extremely strong and optically are very pleasing. Providing a connection via a solvent can be undertaken when both the hanging portion and the profiled stabilizing members are made of synthetic material. The connection locations on the hanging portion and on the stabilizing members are softened with a solvent, the evaporation of which is accompanied by a significant increase in strength in the connection region.

After they are secured, profiled stabilizing members of synthetic material or PVC can be positively connected with complementarily shaped profiled reinforcing members of light metal or steel that are placed on the profiled stabilizing members or are inserted from the side into the stabilizing members where the latter have a hollow shape. These reinforcing members can subsequently be secured by being screwed on or by being otherwise connected.

Figure 5:
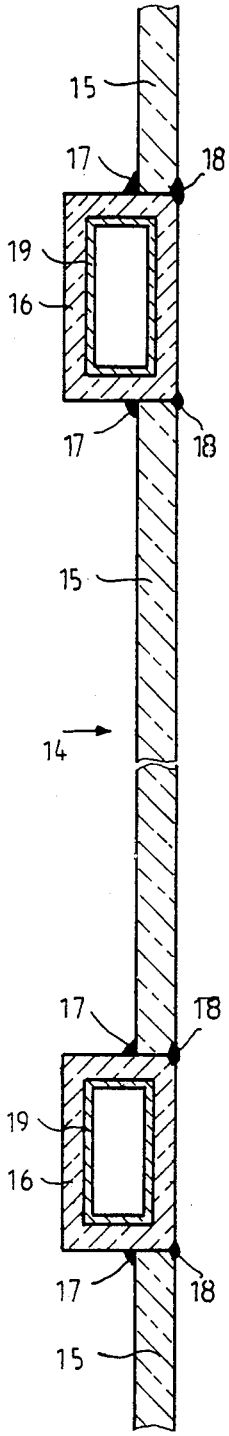
FIG. 5 shows an inventive embodiment of a hanging portion having profiled stabilizing members that are disposed between hanging portion segments and in which are placed profiled reinforcing members, and in particular is a cross-sectional view taken along the line V—V in FIG. 6.
Figure 6:
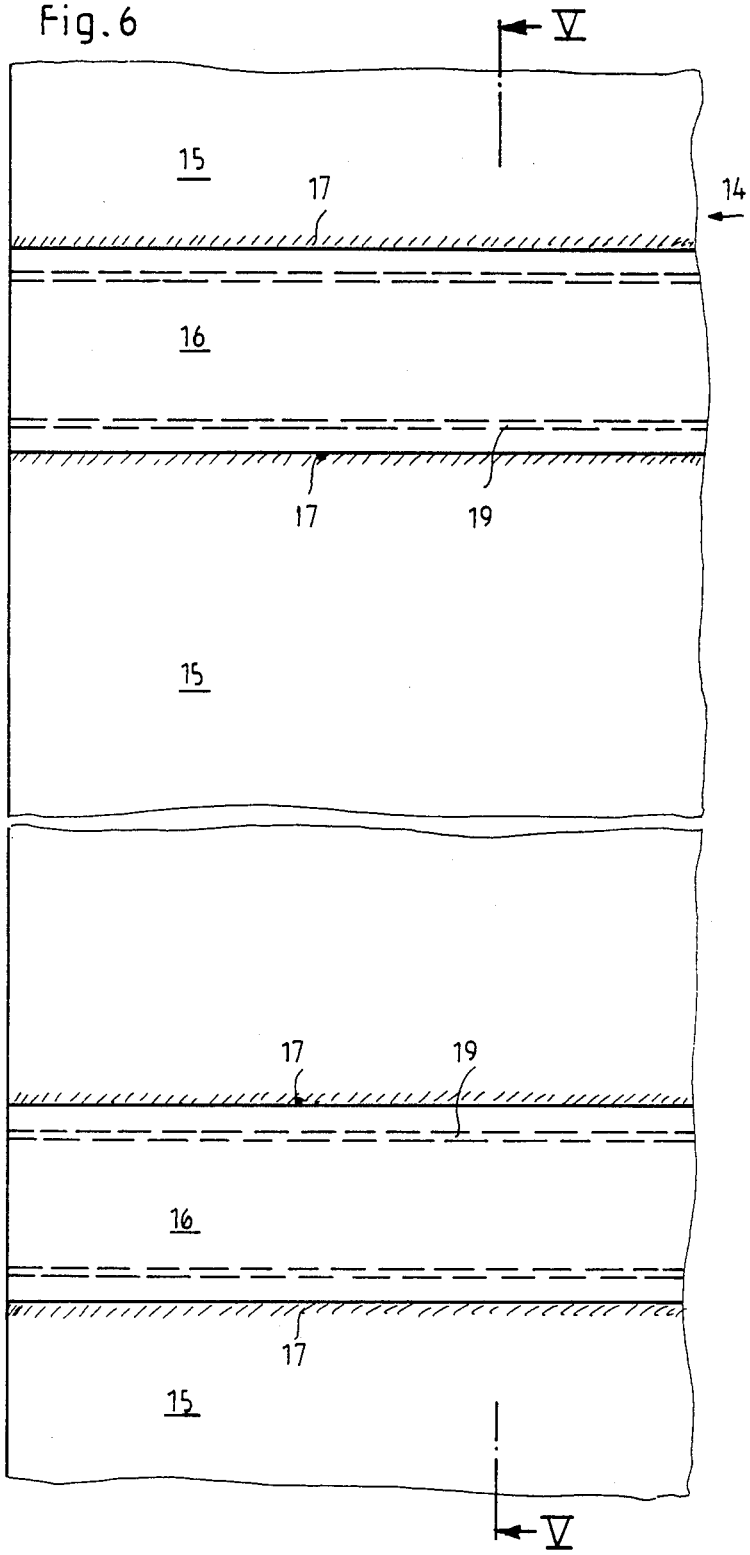
FIG. 6 is a fragmentary view of the hanging portion of FIG. 5.

In the embodiment illustrated in FIGS. 5 and 6, the hanging portion 14 has segments 15 that are separated from one another, with box-shaped profiled stabilizing members 16 being disposed between the segments 15, typically at distances of from 200 to 600 mm. Respective segments 15 butt up against opposite sides of a given profiled stabilizing member 16, and are flush with one side of the latter. This makes it possible to have a quiet and smooth winding process, and reduces wear during the latter. Basically, the segments 15 can be bonded to the profiled stabilizing members 16 by fusion, adhesion, or some other connection method. In the illustrated embodiment, the segments 15 and the stabilizing members 16 are made of PVC, so that a fusion bond with fillet joints 17 and butt seams 18 are provided.

Profiled reinforcing members 19 of steel or light metal are inserted into the profiled stabilizing members 16 from the side. The size of the profiled reinforcing members 19 is such that their outer surface just rests against the inner surface of the profiled stabilizing members. To prevent the reinforcing members 19 from slipping to the side, additional connection elements of the aforementioned type can be provided. Profiled reinforcing members 19 protected in this manner cannot damage the hanging portion 14 when it is rolled up or unrolled.

Figure 7:
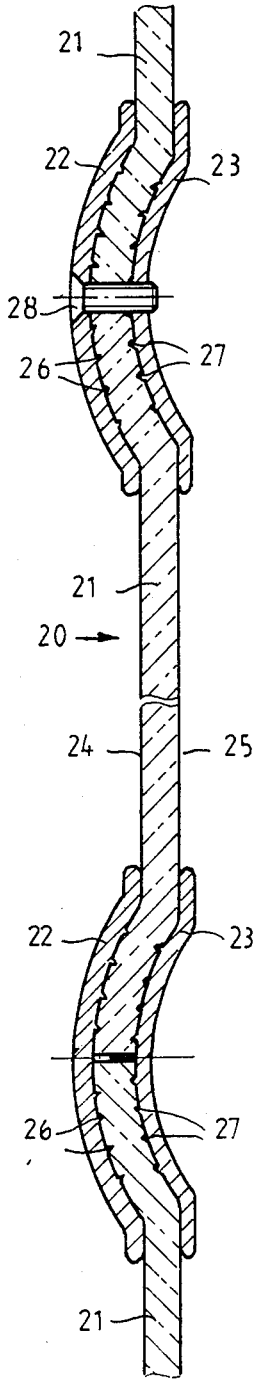
FIG. 7 shows an inventive embodiment of a hanging portion where profiled stabilizing members cover segments of the hanging portion, and in particular is a cross-sectional view taken along the line VII—VII in FIG. 8.
Figure 8:
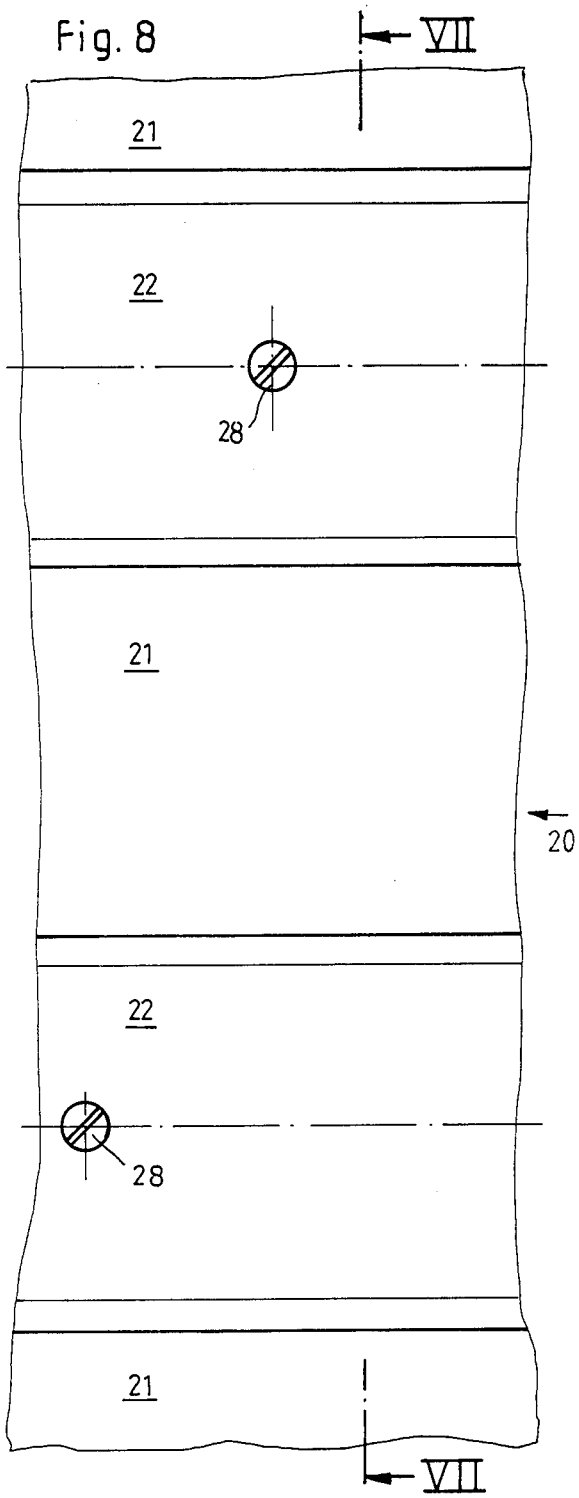
FIG. 8 is a fragmentary view of the hanging portion of FIG. 7.

In the embodiment of FIGS. 7 and 8, the hanging portion 20 is divided into segments 21 as was done with the embodiment of FIGS. 5 and 6. Where the segments 21 abut against one another, there are disposed profiled stabilizing members 22, 23 that each partially covered two segments 21 on the outer side 24 and on the inner side 25.

In the illustrated embodiment, the profiled stabilizing members 22 on the outer side 24, and the profiled stabilizing members 23 on the inner side 25, are curved in conformity to the winding or rolling radius, thus reducing the amount of space required for the rolled-up hanging portion 20. On those sides that face the hanging portion 20, the profiled stabilizing members 22, 23 have pointed studs 26, 27 that project out about 1.5 mm, and penetrate into the segments 21, holding them securely in place, when the profiled stabilizing members 22, 23 are secured by the screws 28. In order not to weaken the cross-sectional areas of the segments 21 too greatly, the studs 26, 27 of connected profiled stabilizing members 22, 23 are expediently offset relative to one another.

The profiled stabilizing members 22, 23, which are coordinated with one another in this fashion, can, for example, be made of extruded light metal. Instead of curved profiled members, it is, of course, also possible to use angled profiled members such as cradles or pans that are coordinated with one another. To improve the blocking of heat and noise of the hanging portion at the junctions of the segments, the latter, where they abut one another, can additionally have provided thereon strips of synthetic material that are covered by the profiled stabilizing members.

Figure 9:
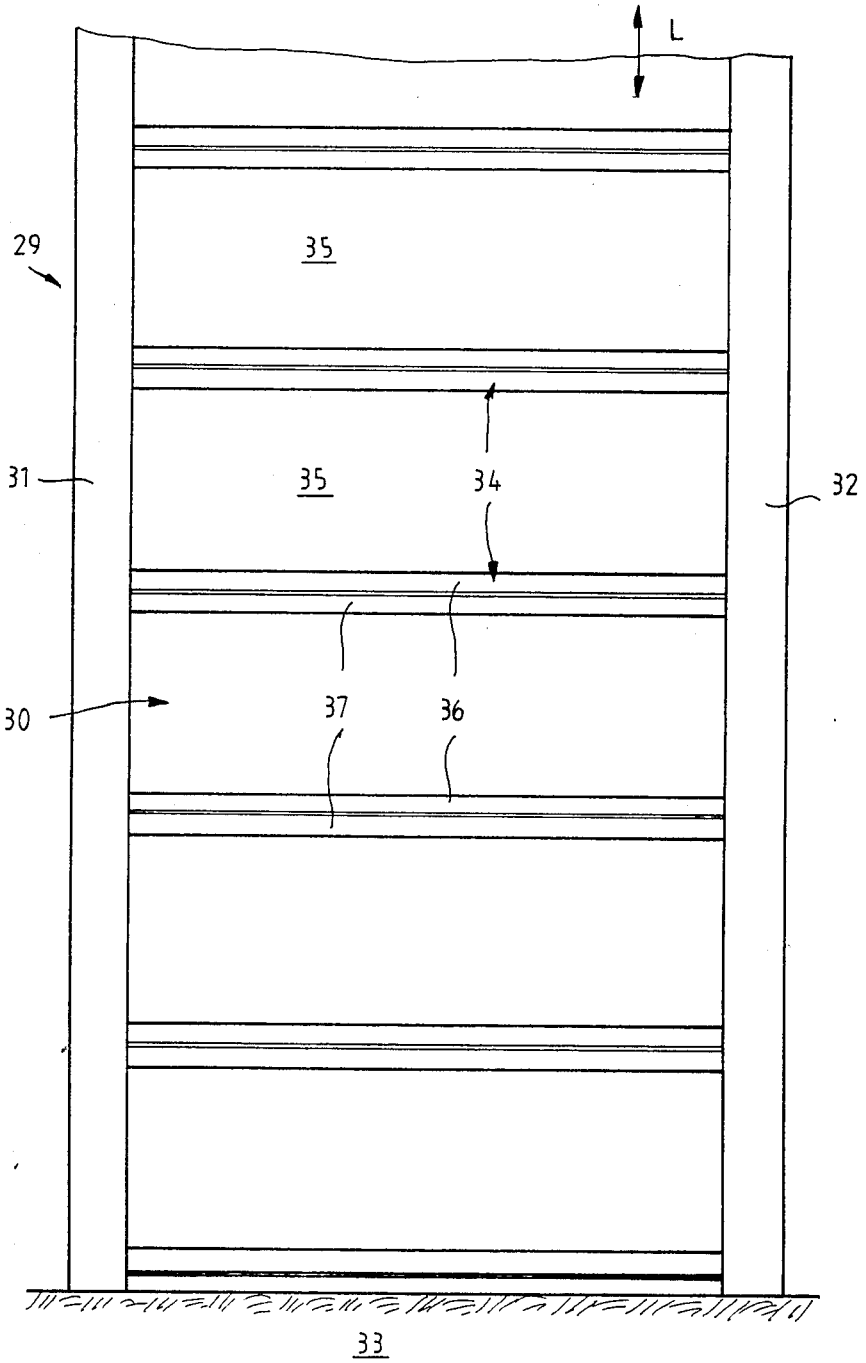
FIG. 9 shows an inventive embodiment of a hanging portion that is in its lateral guide rails and is provided with profiled stabilizing members that comprise pivotable halves.

The fragmentary view of FIG. 9 shows a further inventive roll-up door 29, the hanging portion 30 of which can similarly be moved in the direction of travel 9 in lateral guides 31, 32. These guides are securely anchored to the base or floor 33. Profiled stabilizing members 34 are securely connected to the hanging portion 30. The profiled members 34 are uniformly spaced from one another, and interconnect segments 35 of the hanging portion 30. Each profiled stabilizing member 34 comprises an upper half 36 and a lower half 37, with halves 36, 37 being pivotably interconnected.

Figure 10:
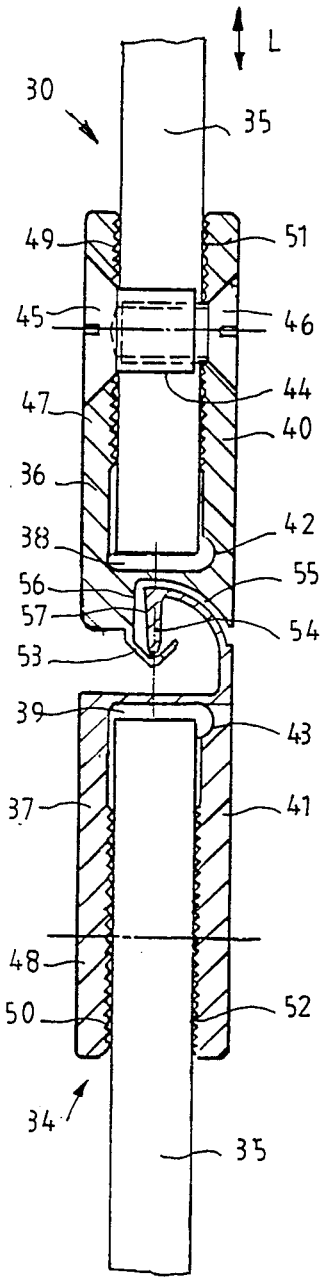
FIG. 10 shows an inventive embodiment of a hanging portion having profiled stabilizing members that comprise pivotable halves, and in particular is a cross-sectional view taken along the line X—X in FIG. 11.
Figure 11:
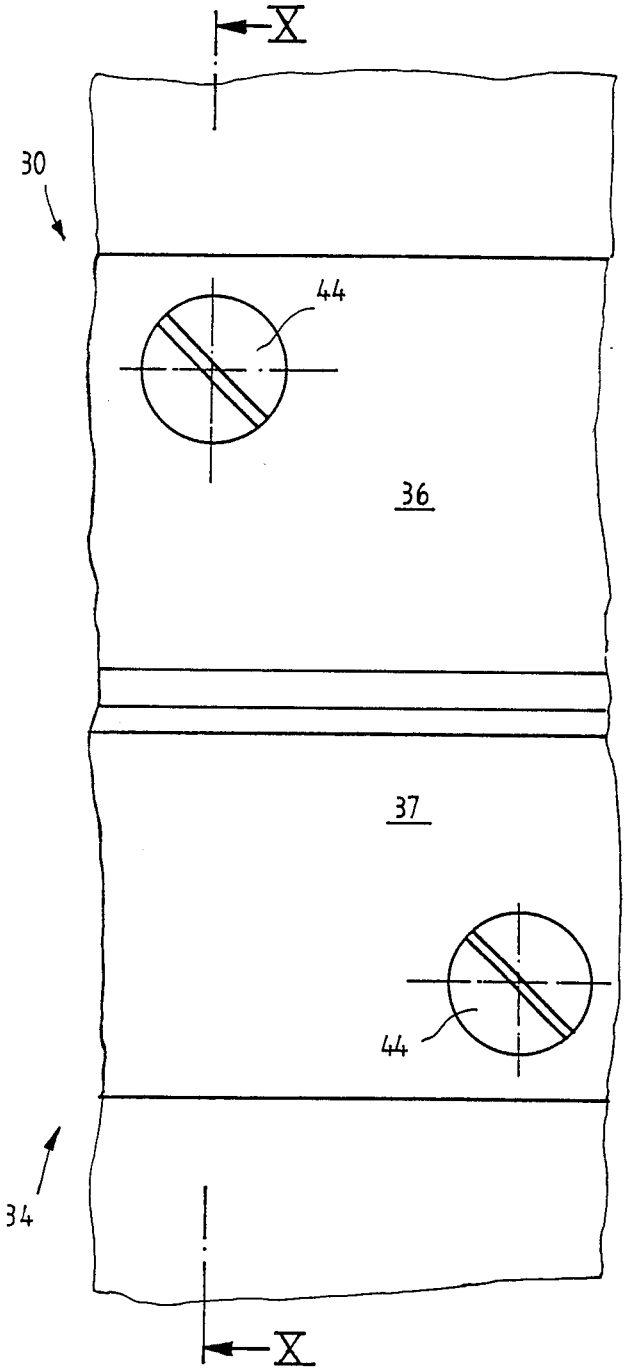
FIG. 11 is a fragmentary view of the hanging portion of FIG. 10.

The interconnection of the halves 36, 37 and the securement of the halves 36, 37 to the segments 35, can be explained better in conjunction with FIGS. 10 and 11. The halves 36, 37 are provided with longitudinal slots 38, 39 for the insertion of the ends of the segments 35 of the hanging portion 30, with the width of the longitudinal slots conforming approximately to the thickness of the segments 35. In order to facilitate insertion of the segments 35 into the longitudinal slots 38, 39, grooves 42, 43 are provided at the base of the sides 40, 41; these grooves 42, 43 make it possible for the sides 40, 41 to bend.

The inserted segments 35 are provided with holes 44 through which securing elements can be placed. In the illustrated embodiment, these securing elements are hollow screws 45 that have an internal thread and flat heads, and flat-head screws 46 that are screwed into the hollow screws 45. The flat heads of the hollow screws 45 and of the flat-head screws 46 are disposed in recessed or countersunk holes in the sides 47, 48, 40, and 41 so that these sides can be secured to the segments 35. In so doing, the projections 49, 50, 51, and 52 on the inner sides of the sides 47, 48, 40, and 41 dig into the surfaces of the segments 35. The cylindrical outer surface of the hollow screw 45 exerts an additional holding force upon the inner wall of the holes 44 in the segments 35.

A recess 53 having a V-shaped cross-sectional shape is provided on the underside of the upper half 36 of the profiled stabilizing member. A flange 54, which is bent in a hook-like fashion and is provided on the upper edge of the lower half 37 of the profiled stabilizing member 34, meshes with the recess 53. The end of the flange 54 is supported on the inner fold of the recess 53, and is rounded off in such a way that it can carry out a pivoting movement in the recess 53. The flange 54 and the upper half 36 of the profiled stabilizing member are curved in the pivoting region, so that a long sealing gap 55 is formed. Provided on the upper half 36 is a perpendicular stop face 56 against which a similarly perpendicular cooperating surface 57 of the flange 54 rests when the halves 36, 37 of the profiled stabilizing member are extended.

FIGS. 12 to 16 will now be described, with these figures illustrating components similar to those of the embodiment of FIGS. 10 and 11.

Figure 12:
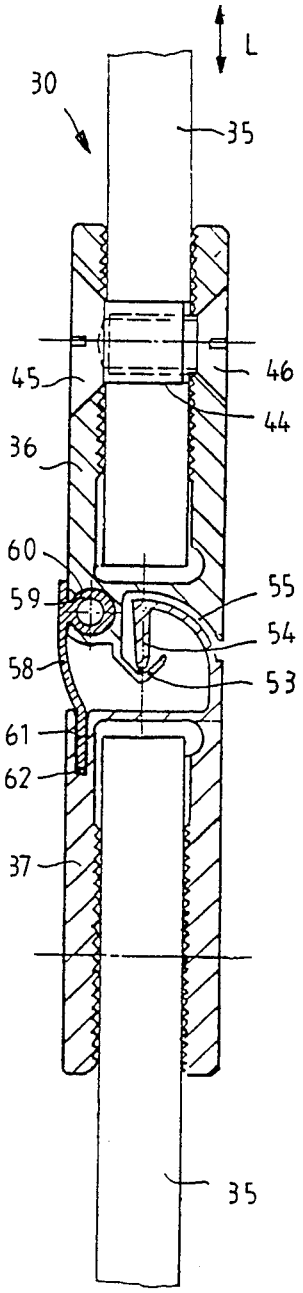
FIG. 12 is a partial cross-sectional view of one inventive embodiment of a hanging portion having profiled stabilizing members of pivotable halves, and including a profiled insulating member.

FIG. 12 shows a profiled stabilizing member where the pivotably interconnected halves 36, 37 are sealed at the location of the joint by a profiled insulating member 58. The latter is provided with an inwardly hollow sealing bead 59 that is placed in an annular groove 60 of the upper half 36 of the profiled stabilizing member. A flat side 61 of the insulating member 58 extends into a deep slot 62 on the upper side of the lower half 37, with the flat side 61 being movable in the slot 62 when the halves 36, 37 execute a pivoting movement.

Figure 13:
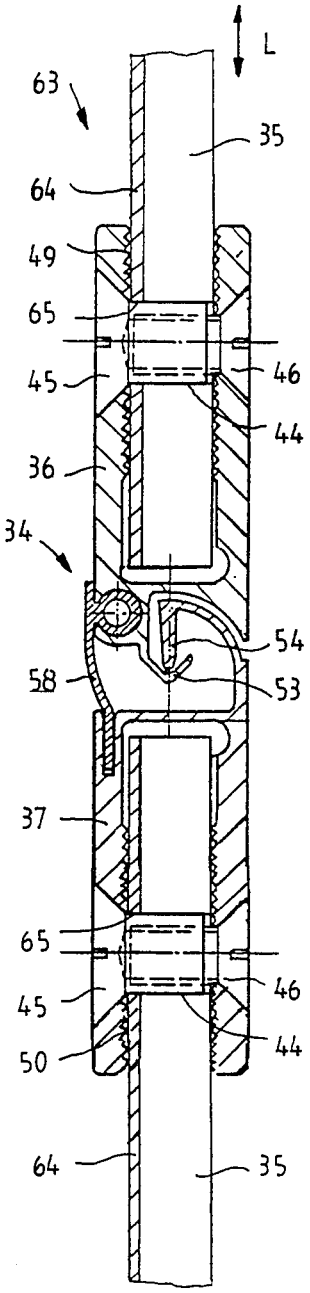
FIG. 13 shows an inventive embodiment of a hanging portion that has profiled stabilizing members of pivotable halves and a profile insulating member, as well as having contact strips, and in particular is a cross-sectional view taken along the line XIII—XIII in FIG. 14.
Figure 14:
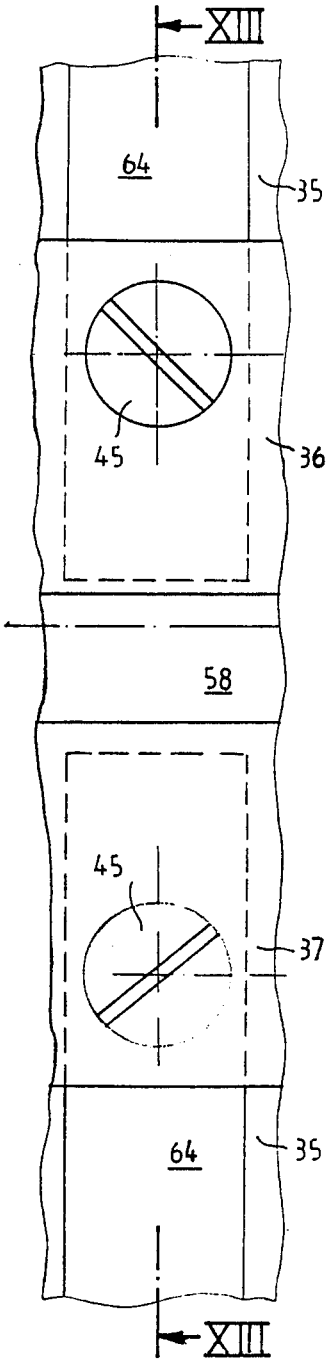
FIG. 14 is a fragmentary view of the hanging portion of FIG. 13.

FIGS. 13 and 14 show a hanging portion 63 that is provided with additional contact strips 64. These strips are interrupted between the halves 36, 37 of the profiled stabilizing member 34, and are clamped in between the halves 36, 37 and the segments 35. In so doing, the projections 49, 50 penetrate the surface of the contact strips 64, resulting in a great holding force. The contact strips 64 are furthermore provided with holes 65, where they are held by the hollow screws 45.

Figure 15:
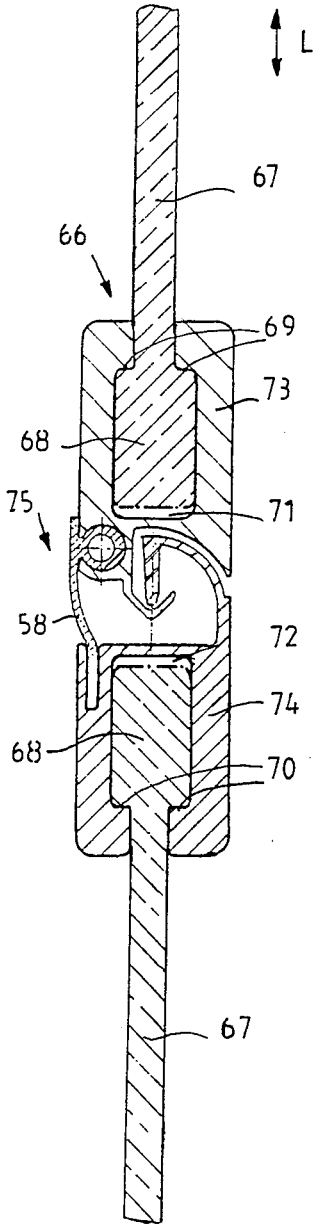
FIG. 15 shows an inventive embodiment of a hanging portion having profiled stabilizing members and segments that are hooked-in via widened portions at the ends, and in particular is a cross-sectional view taken along the line XV—XV in FIG. 16.
Figure 16:
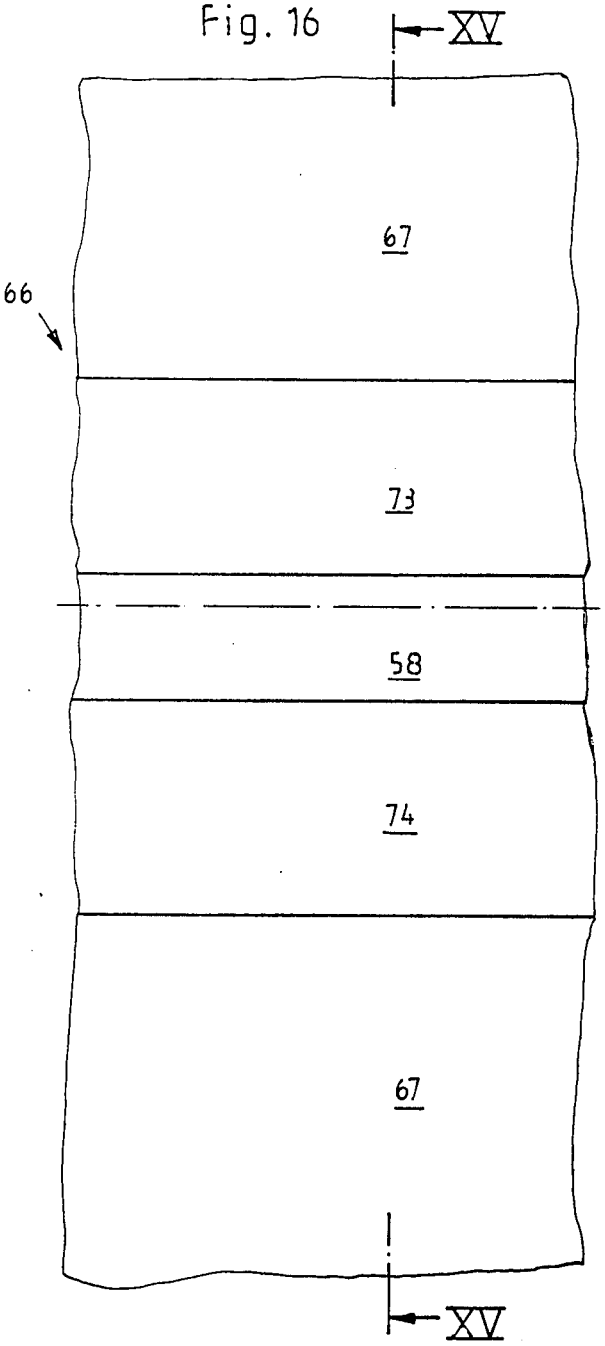
FIG. 16 is a fragmentary view of the hanging portion of FIG. 15.

Finally, FIGS. 15 and 16 show a hanging portion 66, with the ends of the segments 67 thereof being provided with widened portions 68 that interlock with undercuts 69, 70 of the longitudinal slots 71, 72 in the upper half 73 and the lower half 74 of the profiled stabilizing member 75. In the illustrated embodiment, the widened portions 68 have a nearly rectangular cross-sectional shape. However, it would also be possible to provide, for example, spherical widened portions. These widened portions are formed, for example, during extrusion of the segments. When the roll-up door is being assembled, the widened portions 68 of the segments can be placed into the halves 73, 74 from the side.

The present invention is, of course, in no way restricted to the specific disclosure of the specification and drawings, but also encompasses any modifications within the scope of the appended claims.

What I claim is:

1. A roll-up door for opening and closing off door and gate openings, with said door including a winding roller and a hanging portion that is made of flexible material, is in a sheet-like form, and is guided along its sides in a frame; said roll-up door further comprises:

profiled stabilizing members that are securely connected to said hanging portion, with said stabilizing members extending along said hanging portion at right angles to the direction of travel of the latter; said hanging portion comprising segments that are interconnected by said profiled stabilizing members, each of said profiled stabilizing members including two halves that are pivotably interconnected, with the pivot axis of said two halves being parallel to the rolling axis of said hanging portion, and with each half of a given one of said stabilizing members being connected to a different one of said segments of said hanging portion, each of said profiled stabilizing members being provided with an elongated slot for receiving an end of one of said segments of said hanging portions.

2. A roll-up door according to claim 1, in which, when viewed in the hanging state, the upper half of a given one of said profiled stabilizing members is provided with an upwardly open recess that extends in the direction of said pivot axis; and in which the lower half of that stabilizing member is provided with a bent flange that also extends in the direction of said pivot axis and meshes with said recess.

3. A roll-up door according to claim 2, in which those parts of said recess and said flange that contact one another are rounded.

4. A roll-up door according to claim 2, in which said recess has a V-shaped cross-sectional shape, and said flange is supported along the inner fold of said recess.

5. A roll-up door according to claim 2, in which said halves of said profiled stabilizing members are provided with end stops that rest against one another in the extended state of said halves and prevent the latter from carrying out a pivoting movement away from said rolling axis.

6. A roll-up door according to claim 2, in which said halves of said profiled stabilizing members are provided with groove means for receiving a flexible profiled insulating member that spans the gap between said halves.

7. A roll-up door according to claim 6, in which said insulating member is displaceably disposed in one of said groove means.

8. A roll-up door according to claim 1, in which said profiled stabilizing members are each provided with two side elements that delimit said elongated slots, with one of said side elements of each stabilizing member being bendable relative to the other of said side elements.

9. A roll-up door according to claim 8, in which said side elements are secured to hanging portion segments placed in said elongated slots via securing elements that are inserted through said side elements and openings in said ends of said segments.

10. A roll-up door according to claim 9, in which said openings in said segments are holes.

11. A roll-up door according to claim 1, in which those sides of said profiled stabilizing members that face said hanging portion are provided with pointed studs.

12. A roll-up door according to claim 11, in which the studs of a stabilizing member on one side of a hanging portion are offset from the studs of a stabilizing member on an opposite side of that hanging portion.

13. A roll-up door according to claim 1, in which said elongated slots of said profiled stabilizing members are provided with undercuts, and said ends of said segments of said hanging portions are provided with widened portions that interlock with said undercuts.

14. A roll-up door according to claim 1, in which said hanging portion is made of a material selected from the group consisting of PVC, PVC-like synthetic material, rubber, fabric, and combinations of such materials.

15. A roll-up door according to claim 1, in which said profiled stabilizing members are made of a material selected from the group consisting of PVC, PVC-like synthetic material, light metals, steel, and combinations of such materials.

16. A roll-up door according to claim 1, in which said profiled stabilizing members are provided with flexible contact strips that extend in the direction of travel of said hanging portion.

17. A roll-up door according to claim 16, in which said contact strips are disposed between said stabilizing members and said hanging portion.

18. A roll-up door according to claim 16, in which said contact strips are held securely in place on the winding roller.

19. A roll-up door according to claim 16, in which said contact strips are made of a material such as steel, Kevlar, nylon, and other flexible material that stretch only slightly.

20. A roll-up door according to claim 1, in which said hanging portion, for fire or noise protection, is provided with panels made of a material such as sheet metal and insulating material.

21. A roll-up door according to claim 20, in which a plurality of layers and said hanging portion are utilized.

* * * * *

UNITED STATES PATENT AND TRADEMARK OFFICE

CERTIFICATE OF CORRECTION

PATENT NO. : 4,736,785

DATED : Apr. 12, 1988

INVENTOR(S) : Kurt Seuster

It is certified that error appears in the above-identified patent and that said Letters Patent is hereby corrected as shown below:

On the Abstract-Title Page:

[54] ROLL-UP DOOR

Signed and Sealed this

Sixteenth Day of August, 1988

*Attest:*

*Attesting Officer*

DONALD J. QUIGG

*Commissioner of Patents and Trademarks*